US007814950B2

(12) United States Patent
Martin

(10) Patent No.: US 7,814,950 B2
(45) Date of Patent: Oct. 19, 2010

(54) GOLF CLUB GRIP PROTECTION DEVICE

(76) Inventor: Glenn J Martin, P.O. Box 340902, Austin, TX (US) 78734

( * ) Notice: Subject to any disclaimer, the term of this patent is extended or adjusted under 35 U.S.C. 154(b) by 0 days.

(21) Appl. No.: 12/221,782

(22) Filed: Aug. 6, 2008

(65) Prior Publication Data

US 2009/0095386 A1 Apr. 16, 2009

Related U.S. Application Data

(60) Provisional application No. 60/998,289, filed on Oct. 10, 2007.

(51) Int. Cl.
*A63B 57/00* (2006.01)

(52) U.S. Cl. ..... 150/160; 150/155; 206/315.2; 473/409

(58) Field of Classification Search ..... 150/155.16; 206/315.2; 473/206.3, 409; 16/421, 426, 16/DIG. 12; 74/551.8, 551.9, 558.5
See application file for complete search history.

(56) References Cited

U.S. PATENT DOCUMENTS 2,984,486 A * 5/1961 Jones ..... 473/568
4,597,578 A * 7/1986 Lancaster ..... 473/300
4,662,415 A * 5/1987 Proutt ..... 150/160
5,195,568 A * 3/1993 Cirone ..... 150/160
5,261,665 A * 11/1993 Downey ..... 473/303
5,626,527 A * 5/1997 Eberlein ..... 473/203
5,729,864 A * 3/1998 Lie et al. ..... 16/421
6,022,278 A * 2/2000 Vela ..... 473/201
6,500,079 B1 * 12/2002 Tucker, Sr. ..... 473/513
2002/0175098 A1 * 11/2002 Mauch et al. ..... 206/315.3
2003/0096660 A1 * 5/2003 Ward et al. ..... 473/299
2005/0177981 A1 * 8/2005 Wang ..... 16/421
2008/0127459 A1 * 6/2008 Burke et al. ..... 16/426

* cited by examiner

*Primary Examiner*—Sue A Weaver

(57) ABSTRACT

A removable golf club grip protection device protects golf club grips against weather and other outdoor golf course elements that can damage golf club grips during play. The golf club grip protection device comprises an elongated tubular body having a first end and a second end, where the first end is open and the second end is closed. The first end includes an opening configured to slidingly receive one or more golf club grips within an interior portion of the tubular body, where the one or more grips are covered from exposure to outside elements. The tubular body can comprise a flexible material having at least a water-resistant outer surface. The tubular body can also be configured as lengthwise collapsible.

19 Claims, 6 Drawing Sheets

GOLF CLUB GRIP PROTECTION DEVICE

CROSS REFERENCE TO RELATED APPLICATION

The present application claims the benefit of U.S. Provisional Application Ser. No. 60/998,289 filed on Oct. 10, 2007, the disclosure of which is incorporated by reference herein in its entirety.

TECHNICAL FIELD OF THE INVENTION

The present invention relates to a golfing accessory and, more particularly, to an easy-to-use device for the protection of the grips of one or more golf clubs.

BACKGROUND

The inventor is an avid golfer of many years and has struggled with protecting golf grips from moisture, dirt, sand, grass clippings, and other foreign materials when clubs are placed on the ground when not being used. Golfers often carry more than one golf club to the location of the golf ball and have to place the extra clubs on the ground or against another object such as a tree or large rock as they take the next golf shot. There are numerous situations that cause a golfer to take more than one club from his bag and head to the location of his ball—for example, a player may have to park a golf cart quite a distance away from the ball. Because the player will leave his bag strapped in the cart, the player will take multiple clubs with him to his next ball location because he is unable to determine which club to use until he reaches his ball and determines the approximate distance to the hole. Placing the extra club or clubs, especially the grip portion(s), onto the ground (e.g., the rough, the fairway, or the green) however, exposes the grips on the clubs which are not being played to undesirable elements, all of which can affect the effectiveness of golf club grips.

For example, early morning golfers may deal with large amounts of dew on the course and may thus have difficulty keeping their golf grips dry as they proceed through 18 holes of golf. Golfers who place clubs on the ground near putting greens can also expose golf club grips to sand, mud, grass clippings, fertilizer, pesticides, dirt and other materials that may be applied to the grounds of a golf course during normal maintenance. When contaminated, grips can become very slippery or gritty and can shift in the player's hands, thereby adversely affecting the player's score due to a poor shot.

To avoid exposing the golf grip to the elements, golfers have utilized conventional devices. For example, a golfer may wrap a towel around the grip before placing a club on the ground. Although this technique may work for the first few holes, on a wet day, the towel absorbs much moisture and/or dirt each time it is used and can become increasingly ineffective as a protection mechanism. Another conventional technique involves placing a golf tee or ball mark repair tool into the ground, then delicately balancing the grip potion of the club onto the tee or ball mark repair tool at an elevated height from the ground. However, this technique requires the golfer to use finesse and often times can lead to accidental club drops and slips, defeating the purpose of the exercise and getting the golf club grip wet and/or dirty.

SUMMARY OF THE INVENTION

In a first aspect of the present invention, a golf club grip protection device comprises an elongated tubular body having a first end and a second end, where the first end is open and the second end is closed. The first end has an opening configured to slidingly receive one or more golf club grips within an interior portion of the tubular body, the one or more grips being covered from exposure to outside elements. The tubular body comprises a flexible material having at least a water-resistant outer surface. The outer surface of the tubular body can further comprise a material that is slip-resistant even when wet. The interior portion of the tubular body can further comprise a material that allows the golf club grip protection device to slide easily over club grips but keeps the device from sliding off the club grips until pulled off. The tubular body can be tapered smaller from the first end to the second end, allowing any moisture on the exterior portion of the golf club grip protection device to move toward the closed second end and away from the open first end when placed on a relatively flat playing surface.

The shape, design and thickness of the tubular body can allow the golf club grip protection device to retain its form when it comes under the pressure of being squeezed, thrown, folded, twisted or otherwise manipulated. The material used to make the golf club grip protection device can dampen the impact of the golf club grips as they fall on the ground.

In alternative aspects, the opening may be oval-shaped, circle-shaped, triangular-shaped, or rectangular-shaped. In a preferred aspect, the golf club grip protection device is configured to receive one or more grips of standard length. In other aspects, the outer surface includes gripping structures. In a further aspect, the outer surface includes a raised contour to lift and support the tubular body when the device is placed on the ground thereby increasing the height of the golf club grips and golf club shafts to further allow moisture to move away from the golf club grips.

In another aspect, a method of preventing a grip of a golf club from direct exposure to an outside element, where the outside element comprises at least one of moisture, dirt, sand, grass clippings, pesticides, and fertilizers, comprises the following steps. A grip of a golf club is inserted in a first end of a protection device comprising an elongated tubular body having the first end and a second end. The first end is open and the second end is closed. The first end has an opening configured to slidingly receive the golf club grip within an interior portion of the tubular body. The golf club grip is covered from exposure to the outside element. The tubular body comprises a flexible material having at least a water-resistant outer surface. The method also includes placing the protection device with the golf club grip enclosed therein on a playing surface.

In another aspect, a golf club grip protection device includes a tubular body that is lengthwise collapsible having a first end and a second end, where the first end is open and the second end is closed. The tubular body is extendable from a first length to a second length longer than the first length. The first end includes an opening configured to slidingly receive one or more golf club grips within an interior portion of the tubular body when the body is extended. The one or more grips that are received in the device are covered from exposure to outside elements. The tubular body comprises a material having at least a water-resistant outer surface. The tubular body may comprise a plurality of ridges or gussets. The device can further include a collar disposed at or near the first end that extends the length of the tubular body when the body is placed in the collapsed state and that engages a rim feature disposed at or near the closed end of the device so that the device can remain locked in the collapsed position. When in use, the rim can be disengaged from the collar so that the body is extendable to the second length.

The above summary of the present invention is not intended to describe each illustrated embodiment or every implementation of the present invention. The figures and the detailed description that follows more particularly exemplify these embodiments.

BRIEF DESCRIPTION OF THE DRAWINGS

The present invention will be further described with reference to the accompanying drawings, wherein.

Figure 1:
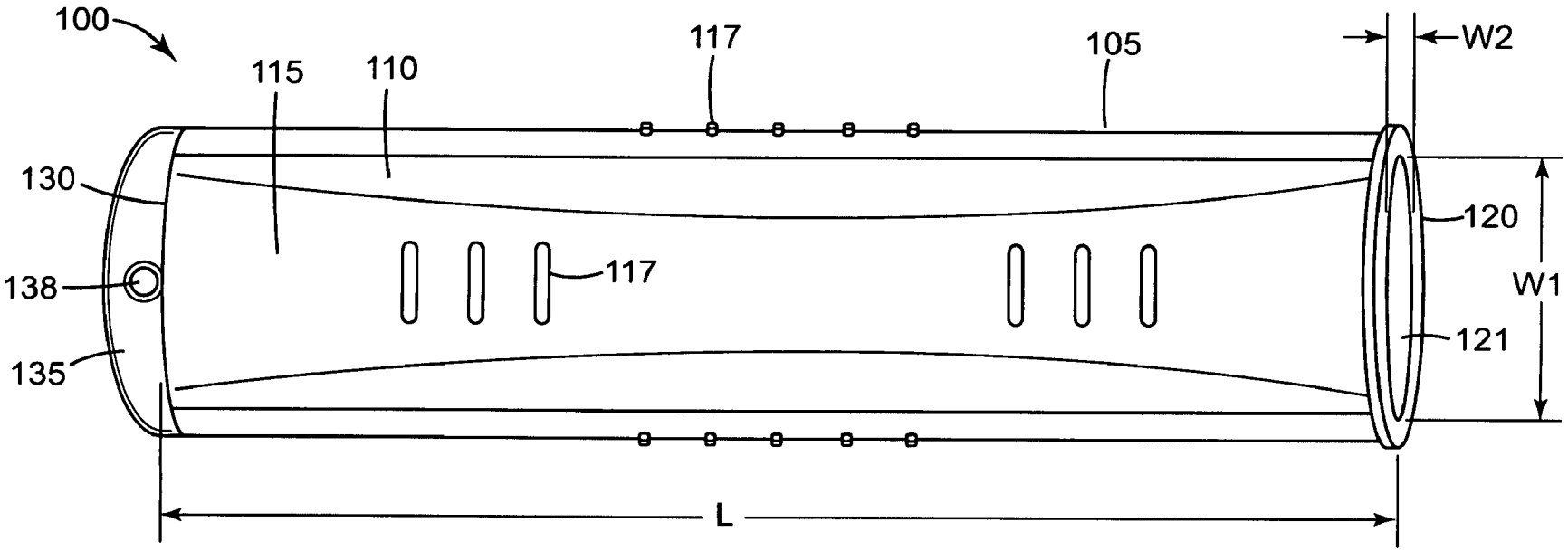
FIG. 1 is a side view of a golf club grip protection device according to a first aspect of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention as defined by the appended claims.

DETAILED DESCRIPTON

In the following Detailed Description, reference is made to the accompanying drawings, which form a part hereof, and in which is shown by way of illustration specific embodiments in which the invention may be practiced. In this regard, directional terminology, such as "top," "bottom," "front," "side," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention.

The golf club grip protection device described herein in exemplary embodiments is a flexible, universally-sized protector for any standard length golf club grip. The golf club grip protection device protects one or more golf club grips from outside elements, such as moisture, dirt, sand, grass clippings, pesticides, fertilizers and other environmental elements. The golf club grip protection device can be easily slid onto and easily removed from the golf club grip(s). As a golfer may bring extra clubs with him or her prior to executing a shot, the golf club grip protection device can be placed over the grips of the extra golf clubs prior to placing the extra clubs onto the ground, protecting the grips from the elements.

FIG. 1 shows a first aspect of the present invention, a golf club grip protection device 100. In this first aspect, golf club grip protection device 100 is a generally tubular structure having a body 105 with a first end 120 and a second end 130. In this aspect, first end 120 is open, having a generally oval opening 121, and a second end 130, which is closed. Open end 120 is configured to receive one or more golf club grips. In one aspect, the opening is of appropriate size to receive a single golf club grip. In another aspect, the opening is of appropriate size to receive two golf club grips at the same time. In yet another aspect, the opening is of appropriate size to receive more than two golf club grips at the same time.

For example, in a preferred aspect, golf club grip protection device 100 has an opening 121 having a width (W1) of from about 1.25 inches to about 4 inches on the major axis and a width (W2) of from about 1.25 inches to about 3 inches on its minor axis, thus providing a size of from about 1.56 $in^2$ to about 12 $in^2$. In one example, the opening 121 is oval in shape and is about 1.25 inches wide (W2) on its minor axis and about 3.0 inches wide (W1) on its major axis.

As shown in FIG. 1, golf club grip protection device 100 has a generally oval opening 121. In alternative aspects, such as shown in FIGS. 3B-3E, the open end 120 can be shaped as a triangular opening 121*a* (FIG. 3B), a circular opening 121*b* (FIG. 3C), a rectangular opening 121*c* (FIG. 3D), or a generally rectangular opening with rounded sides 121*d* (FIG. 3E). Other polygonal shapes may also be utilized, as would be apparent to one of ordinary skill in the art.

Figure 2:
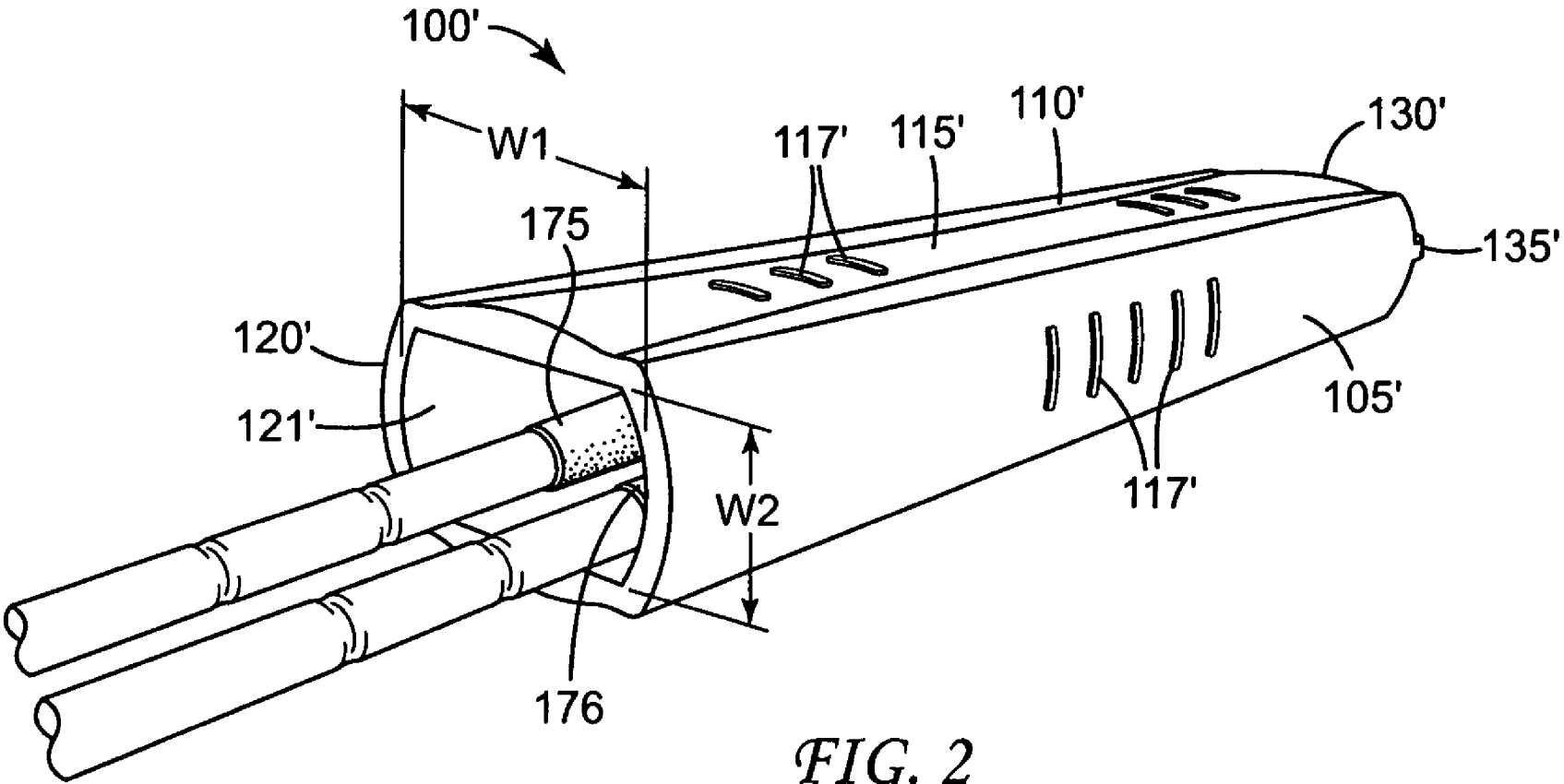
FIG. 2 is an isometric view of a golf club grip protection device according to another aspect of the present invention enclosing two golf club grips therein.

In another example, see e.g., FIG. 2, a golf club grip protection device 100' has an opening 121' that is generally rectangular in shape (e.g., with rounded sides and/or corners) and is about at least 1.25 inches along its minor axis (W2) and about at least 2.250 inches along its major axis (W1). In one preferred aspect, opening 121' can be from about 1.375 inches along its minor axis (W2) and about 2.75 inches along its major axis (W1). Each rounded side of the tubular body 105' of the golf club grip protection device 110' can have an arch-shaped cross section that runs the entire length of the tubular body to support the top and bottom sides and help keep the first end 121' open at all times.

Referring back to FIG. 1, the closed end 130 can optionally include an attachment feature 135 that is utilized to help store device 100 in a straightforward manner. For example, attachment feature 135 (135' in FIG. 2) can comprise a hole 138 configured to engage a clip or hook so that the device 100 can be hung from the side of a golf bag or golf cart when not in use.

The golf club grip protection device 100 has a generally tubular body 105 that is elongated, such that the length (L) of device 100 is much longer than the width. In a preferred aspect, the length (L) is from about 9 inches to about 14 inches, sufficient to cover or enclose the entire length of any standard golf club grip. As the size and shape of the grips on a putter, irons and woods can all be different, the golf club grip protection device is preferably universally-sized to be used interchangeably with different sized club grips. The golf club grip protection device can also be configured for women's grips, children's grips, junior's grips, and oversized grips, as would be apparent to one of ordinary skill in the art given the present description.

In an exemplary aspect, the body 105 is formed from a flexible, resilient material so that it can be folded, bent or tossed around and will retain its original shape. An exemplary material can be, for example, a thermoplastic elastomer, so that the manufacturing process can utilize conventional molding technology. Other materials may include polymer-based materials, silicone, latex, and formed foam. For example, in an alternate embodiment, the body 105 can be made of formed foam and covered with an outer water resistant or water proof coating material such as neoprene. Thus, the body material is preferably at least water resistant (e.g., water repellant or water proof). The body 105 includes an outer surface 110. In a preferred aspect, surface 110 can include gripping structures 117 disposed on at least a portion of surface 110 that provide for more straightforward gripping of the device 100 by the golfer (as the outer surface may get wet or dirty when in use). The gripping structures 117 may be formed from the same material as the body 105 or a different material and can be configured as small protrusions, ridges, bumps or other shapes. The texture of the material used on the outer surface 100 can also have a tacky consistency to help provide for a more straightforward gripping of the device.

As mentioned above, in one aspect of the invention, the golf club grip protection device can include an opening that is of appropriate size to receive two golf club grips at the same time. As shown in FIG. 2, golf club grip protection device 100' includes a first end 120' having an opening 121' that is generally rectangular in shape and can receive and enclose the grips of two golf clubs 175, 176. A second end 130' is closed. Similar to device 100, golf club grip protection device 100' includes a generally tubular body 105' that is elongated, such that the length of device 100' is much longer than the width. Body 105' includes an outer surface 110', which can include gripping structures 117' disposed on at least a portion of surface 110' that provide for more straightforward gripping of the device 100' by the golfer. The gripping structures 117' may be formed from the same material as body 105' or a different material. The second end 130' is slightly smaller than the first end 120', allowing for the body 105' to taper by a relatively small angle (e.g., by about 0.5 to about 3.0 degrees) toward the closed second end 130' to enable any moisture on the outer surface 110' to move away from the opening 121'.

Figure 3A:
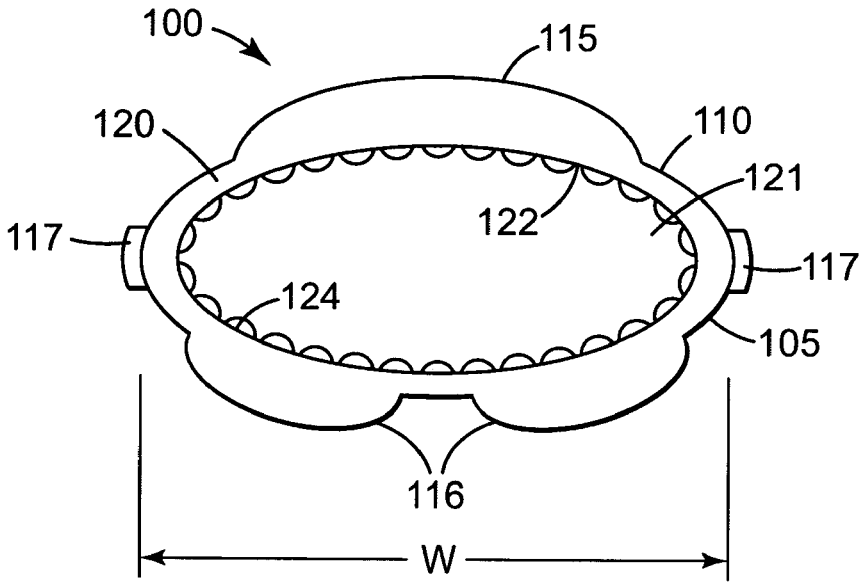
FIG. 3A is an end view of the opening of the golf club grip protection device according to an aspect of the present invention.
Figure 3B:
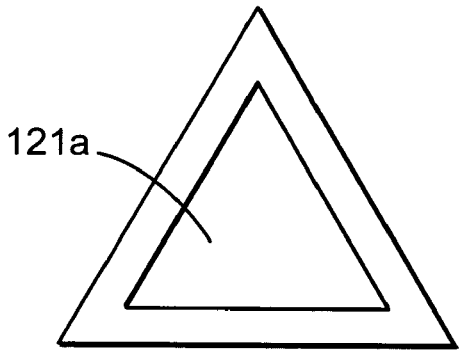
FIGS. 3B-3E are end views of openings of golf club grip protection devices according to other aspects of the present invention.
Figure 3C:
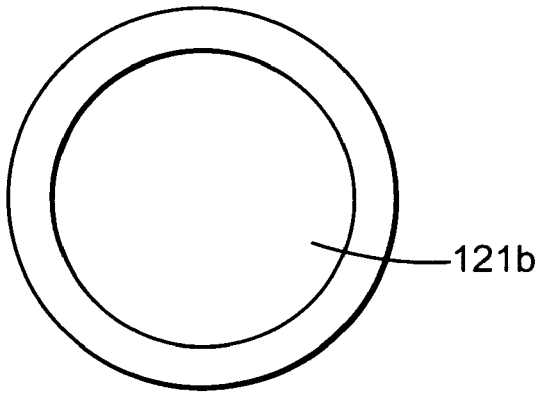
Figure 3D:
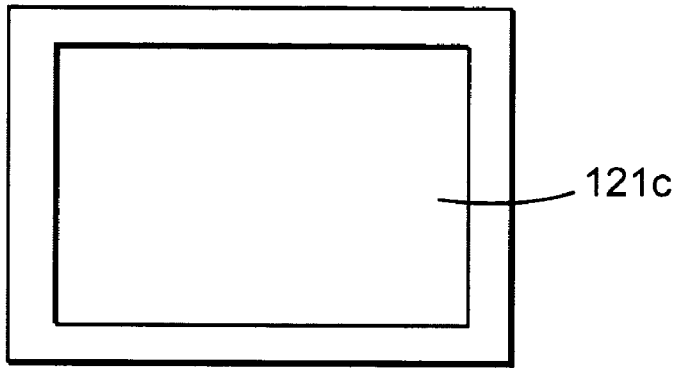
Figure 3E:
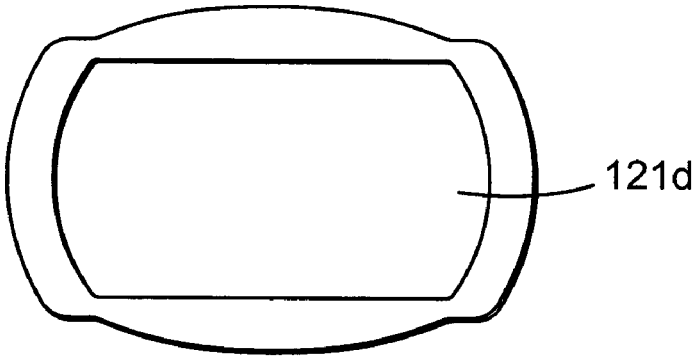

In another exemplary aspect, surface 110 or 110' can optionally include one or more raised contours, such as raised contour 115 or 115' shown in FIGS. 1, 2 and 3A. The raised contour can be formed as part of the mold or can be formed through an embossing technique. As shown in the front view of FIG. 3A, the raised contour 115 can be formed as a single elevated arched element extending outwardly from surface 110.

Alternatively, surface 110 can include a double raised contour structure 116. The raised contours can support the device 100 (or 100') and lift it higher off the ground (e.g., by about 0.25 to 2 inches) when in use, such as is shown in FIG. 2. The raised contours can extend the entire length of the device 100 or a portion thereof and can be disposed on one or more sides of the device 100 (or 100'). For example, as is shown in FIG. 2, device 100' can receive two golf club grips 175, 176 and a raised contour on the bottom surface can set the device at an additional height from the ground surface. This feature elevates the grip(s) which in turn can help keep the shaft(s) off the playing surface all the way to the club head and reduce the potential of moisture or dirt sliding down the shaft(s) toward the grip(s). This feature elevates the grip(s) which in turn can keep the grips dry even when the shafts are exposed to moisture in, e.g., tall grass.

Figure 3F:
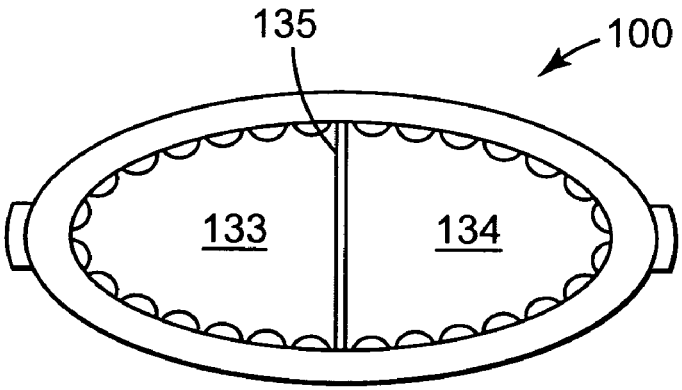
FIG. 3F is an end view of a golf club grip protection device having a partition according to another aspect of the present invention.

As further shown in FIG. 3A, the body 105 of the golf club grip protection device 100 has an outer surface 110 and an inner surface 122. The inner surface 122 can have a tacky texture to keep the device 100 from slipping off of the grips. Inner surface 122 can optionally include inner surface features 124 that help retain a golf club grip placed in the opening 121 so that the grip does not accidentally slide out of the enclosure. These inner surface features can be formed as bumps, ridges, or hairs, as appropriate. In a further alternative aspect, as is shown in FIG. 3F, golf club grip protection device 100 can optionally include a partition 135 that divides the enclosure into separate chambers 133 and 134 to receive separate golf club grips. The partition 135 can be formed from the same material as the body 105.

Figure 4A:
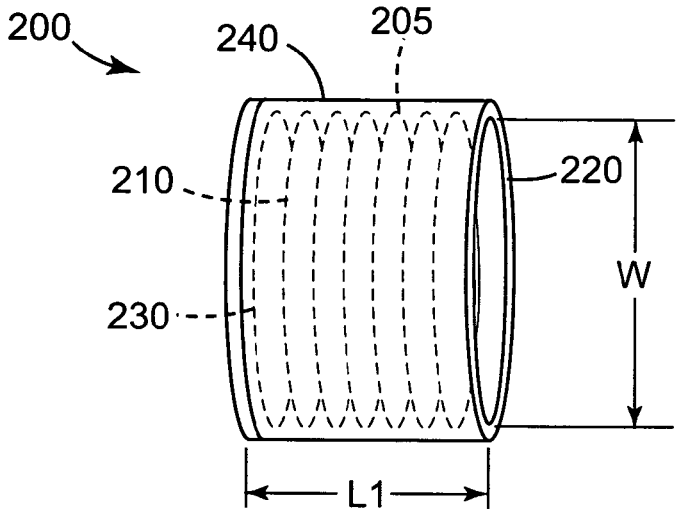
FIGS. 4A and 4B show different views of a golf club grip protection device according to an alternative aspect of the present invention.
Figure 4B:
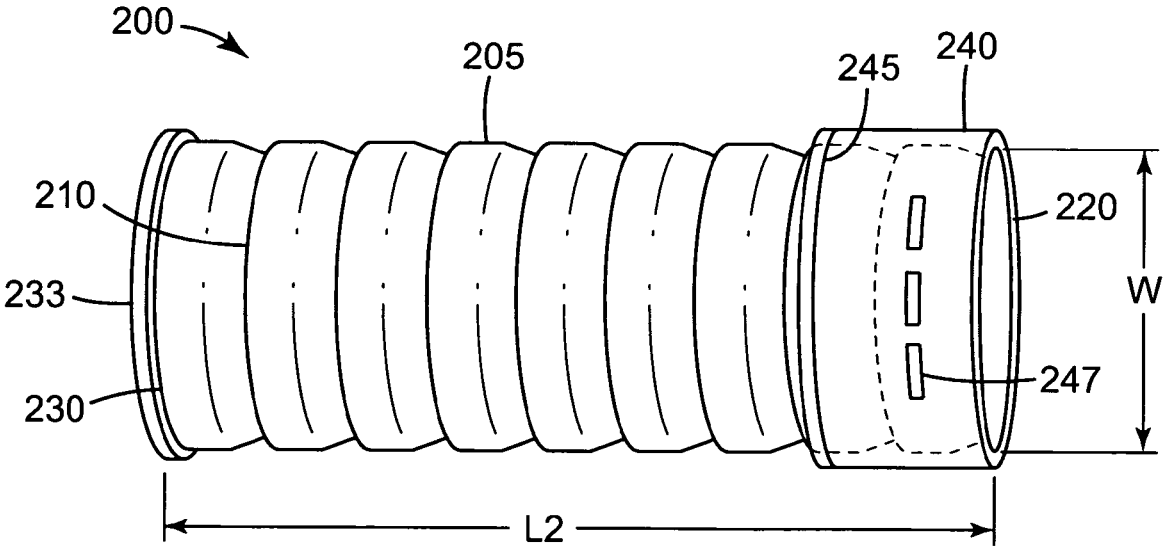

FIGS. 4A and 4B show yet another alternative embodiment, a golf club grip protection device 200 that is lengthwise collapsible. For example, device 200 can include a body 205 formed from a collapsible material, such as is shown in FIG. 4A, where the tubular body 205 can be collapsed to a first length (L1). Body 205 can be formed from a material such as plastic, latex, or a polymer-based material. In another aspect, the body 205 is formed from a weather-proof fabric material. In its collapsed state, the body 205 can include a plurality of compressed gussets 210, having an accordion-like structure. In FIG. 4B, the device 200 is placed in an extended state, where the closed end 230 is pulled away from open end 220 (or vice versa), extending the length of the device 200 to a second length (L2). In a preferred aspect, the second length (L2) is from about 9 inches to about 14 inches, sufficient to entirely cover or enclose any standard length golf club grip, and can include collapsible segments that can be extended and locked in its extended state. The open end 220 can be configured in a manner similar to that described above. For example, open end 220 can include an opening having a generally oval shape, a generally circular shape, a generally rectangular shape, a generally triangular shape, or another polygonal shape.

In an exemplary aspect, the open end 220 can further include a retention device, such as collar 240, which extends along the side of the tubular body 205. The collar 240 can help secure the device 200 in a collapsed state until the device is needed for use. The collar can have a length that is about the same as or slightly longer than first length (L1) of the golf club protection device 200. This collar 240 can have a lip 245 at the unattached end of the collar 240. This collar lip 245 can have a thickness the same as or slightly greater than the rest of the collar 240.

In this exemplary aspect, the closed end 230 can include an interlocking rim 233 that engages with the collar lip 245 to temporarily hold the device 200 in a collapsed state. In one aspect, the interlocking rim 233 can be formed from a plastic or other elastic material. The mating of the interlocking rim 233 and cover lip 245 can be configured to be releasable in a straightforward manner, suitable for repeated openings and closings.

For example, when the golfer collapses the golf club grip protection device 200 completely, the collar lip 245 will engage the interlocking rim 233 of the closed end to keep the device in its collapsed form. The golfer can keep the device in its collapsed form until he or she is ready to use the device, e.g., by inserting one or more grips into the device. The golfer can extend the tubular body 205 by separating the closed end 230 from the collar 240 by disengaging the collar lip 245 from the interlocking rim 233. Alternatively, the golfer can simply insert the golf club grip(s) and push the closed end 230 out while gripping the collar 240. Other retention mechanisms can also be utilized as would be apparent to one of skill in the art given the present description. In this aspect, the outer surface of the collar 240 can optionally include gripping structures 247 disposed on at least a portion of the surface to provide for a more straightforward gripping of the collar 240 by the golfer.

Figure 5A:
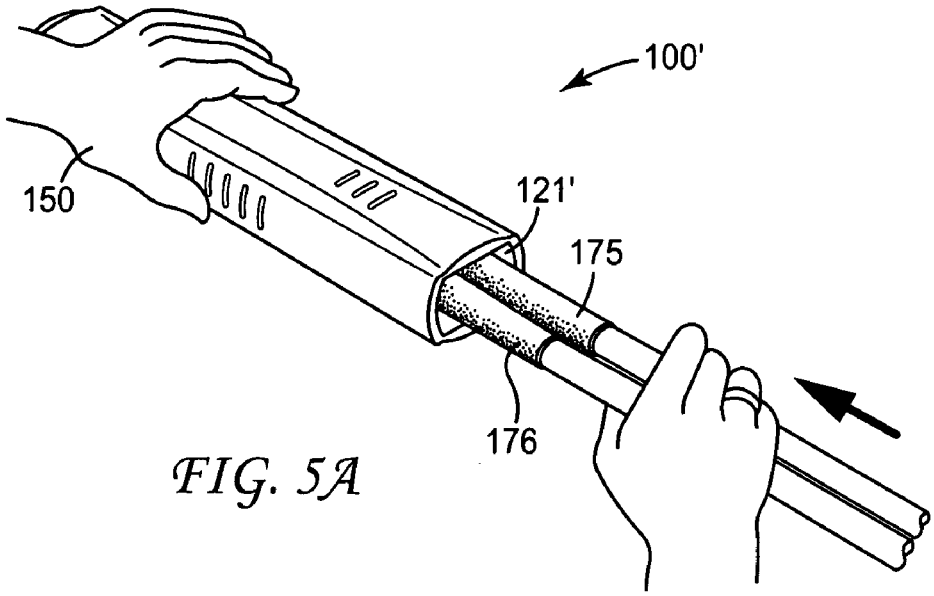
FIGS. 5A and 5B show a method of preventing golf club grips from direct exposure to outside elements.
Figure 5B:
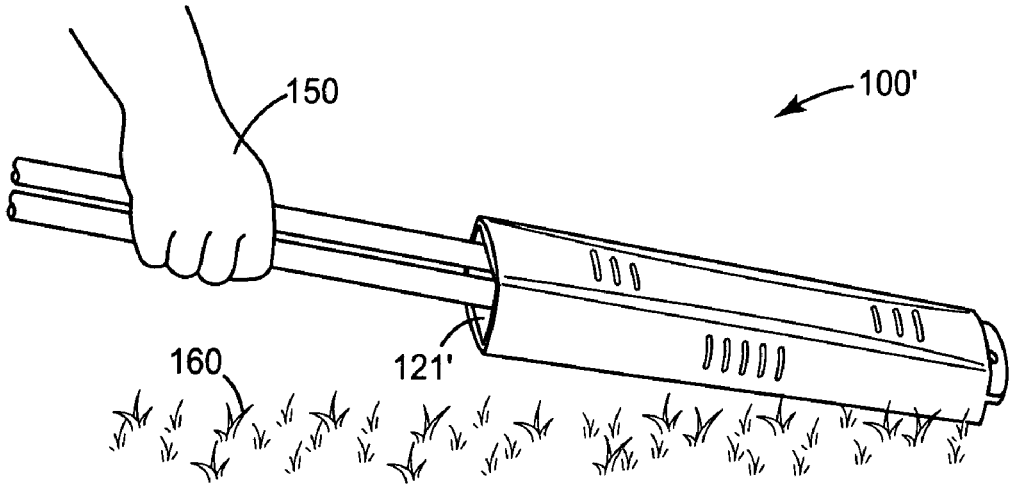

FIGS. 5A and 5B show an exemplary method in accordance with the present invention where golf club grips are protected from direct exposure to outside elements. A golfer 150 inserts two golf club grips 175, 176 into the opening 121' of the golf club grip protection device 100' and then places the protection device with the golf club grips enclosed therein on a playing surface 160.

In operation, a golfer brings two or more golf clubs to the position of his golf ball. The golfer selects the specific club for the shot, then slides the golf club grip protection device 100, 100', 200 on to the extra club or clubs and places the golf club grip protection device and extra club(s) on the ground. After hitting the shot, the golfer picks up his extra clubs as he walks to the next shot. As the golfer is walking, he can slide the golf club grip protection device off of the club(s). Because the golf club grip protection device can be made in one piece and without snaps, latches or hinges to fasten it to the club, the golfer can slide on the golf club grip protection device on and off in a straightforward manner.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

What is claimed is:

1. A golf club grip protection device for protecting more than one golf club grip, wherein each golf club includes a grip and a shaft, comprising:

an elongated tubular body having an open first end and a closed second end, wherein the first end comprises a single opening configured to slidingly receive more than one golf club grip for placement of the golf club grips within an interior portion of the tubular body, the golf club grips being completely covered from exposure to outside elements when the golf clubs are laying on a playing surface, the tubular body comprising a flexible material having at least a water-resistant outer surface, the tubular body tapering smaller from the first end to the second end to direct moisture on an outer surface of the protection device toward the second end and away from the golf club grips.

2. The golf club grip protection device of claim 1, wherein the tubular body comprises one of a molded elastomer material, molded silicone material and a molded plastic material.

3. The golf club grip protection device of claim 1, wherein the tubular body is formed from a resilient material that will retain its original shape after being folded and bent.

4. The golf club grip protection device of claim 1, wherein at least two opposite sides of the tubular body have an arch-shaped cross section extending a substantial length of the tubular body configured to retain the first end as open at all times.

5. The golf club grip protection device of claim 1, wherein the tubular body further comprises a formed foam material, wherein the outer surface comprises a water resistant coating.

6. The golf club grip protection device of claim 5, wherein the outer surface further comprises neoprene.

7. The golf club grip protection device of claim 1, wherein the interior portion of the tubular body comprises a partition to divide the interior portion into at least two chambers.

8. The golf club grip protection device of claim 1, wherein the opening has a size of from about 1.56 $in^2$ to about 12 $in^2$.

9. The golf club grip protection device of claim 1, wherein the opening has a generally rectangular shape, wherein at least one of the side walls and the corners of the opening are rounded.

10. The golf club grip protection device of claim 1, wherein the opening has one of a circular, triangular, rectangular and oval shape.

11. The golf club grip protection device of claim 1, wherein the second end includes an attachment mechanism.

12. The golf club grip protection device of claim 1, wherein the tubular body has a length of from about 9 inches to about 14 inches.

13. The golf club grip protection device of claim 1, wherein the outer surface further includes a plurality of gripping structures.

14. The golf club grip protection device of claim 1, wherein at least one outer surface includes a raised contour to increase the height of the golf club grips and golf club shafts from the ground when the device is placed on the ground.

15. The golf club grip protection device of claim 1, wherein the outer surface includes a raised contour disposed on a top surface and an opposite surface to increase the height of the golf grips and golf club shafts from the ground when the device is placed on the ground.

16. The golf club grip protection device of claim 14, wherein the raised contour includes a double contour structure.

17. The golf club grip protection device of claim 14, wherein the raised contour is disposed along a substantial length of the outer surface.

18. A golf club grip protection device, comprising:

a tubular body that is lengthwise collapsible having a first end and a second end, wherein the first end is open and the second end is closed, the tubular body extendable from a first length to a second length longer than the first length, the first end having an opening configured to slidingly receive one or more golf club grips within an interior portion of the tubular body when the body is extended, the one or more grips being covered from exposure to outside elements, the tubular body comprising a material having at least a water-resistant outer surface; and a retention device to retain the golf club grip protection device in a collapsed state, wherein the retention device comprises a collar disposed on and coupled to an outer surface of the tubular body proximate to the first end, wherein the golf club grip protection device remains in the collapsed state when an interlocking rim feature disposed on the second end is engaged with the collar, and wherein the retention device is releasable so that the tubular body is lengthwise extendable when the interlocking rim feature is disengaged from the collar.

19. A method of preventing a grip of a golf club from direct exposure to an outside element, the outside element comprising at least one of moisture, dirt, sand, grass clippings, pesticides, and fertilizers, comprising the steps of:

inserting one or more golf club grips in a first open end of a protection device comprising an elongated tubular body having the first end and a closed second end so that the golf club grips are completely covered by the tubular body, wherein the first end comprises a single opening configured to slidingly receive more than one golf club grip for placement of the golf club grips within an interior portion of the tubular body, the golf club grips being completely covered from exposure to outside elements when the golf clubs are laying on a playing surface, the interior portion configured to retain the golf club grips within the tubular body until the device is slidingly removed, the tubular body comprising a flexible material having at least a water-resistant outer surface, the tubular body tapering smaller from the first end to the second end to direct moisture on an outer surface of the protection device toward the second end and away from the golf club grips placing the protection device with the one or more golf club grips enclosed therein on a playing surface.

* * * * *